US005782106A

United States Patent [19]

Park

[11] Patent Number: 5,782,106

[45] Date of Patent: Jul. 21, 1998

[54] REFRIGERATOR HAVING WARMER COMPARTMENT

[75] Inventor: Sang Tae Park, Seoul, Rep. of Korea

[73] Assignee: LG Electronics Inc., Seoul, Rep. of Korea

[21] Appl. No.: 774,220

[22] Filed: Dec. 27, 1996

[30] Foreign Application Priority Data

Dec. 29, 1995 [KR] Rep. of Korea ..... 1995-67163

[51] Int. Cl.[6] ..... F25D 19/00; F25B 27/00; F25B 21/02

[52] U.S. Cl. ..... 62/452; 62/3.2; 62/238.2; 62/238.6; 62/455

[58] Field of Search ..... 62/3.2, 3.3, 3.6, 62/238.1, 238.2, 238.6, 331, 452, 455

[56] References Cited

U.S. PATENT DOCUMENTS

| | | | |
|---|---|---|---|
| 2,412,774 | 12/1946 | Hoffman | 62/238.1 |
| 2,465,107 | 3/1949 | Mascioli et al. | 62/238.1 |
| 2,467,464 | 4/1949 | Carriere | 62/238.1 |
| 2,487,851 | 11/1949 | Charland | 62/238.1 |
| 2,758,452 | 8/1956 | Walz | 62/238.1 |
| 2,943,452 | 7/1960 | Buchanan | 62/238.2 |
| 3,052,100 | 9/1962 | Homkes | 62/3.6 |
| 3,134,242 | 5/1964 | Hanson | 62/238.1 |
| 3,146,601 | 9/1964 | Gould | 62/3.6 |
| 3,209,547 | 10/1965 | Elfving | 62/3.6 |
| 4,355,521 | 10/1982 | Tsai | 62/238.6 |
| 4,472,945 | 9/1984 | Cech et al. | 62/3.3 |
| 5,388,427 | 2/1995 | Lee | 62/331 |

FOREIGN PATENT DOCUMENTS

| | | | |
|---|---|---|---|
| 1763822 | 9/1992 | U.S.S.R. | 62/238.6 |

*Primary Examiner*—William Doerrler

[57] ABSTRACT

A refrigerator includes a freezer compartment, a refrigerator compartment, a warmer compartment, a machine compartment having a compressor and a condenser for cooling the freezer compartment and the refrigerator compartment, and a heat transmitter for transmitting heat from the machine compartment to the warmer compartment. The heat transmitter includes a heat transmitting member for transmitting heat from the machine compartment to the warmer compartment. A heat conducting member is attached to the heat transmitting member for conducting heat from the machine compartment to the heat transmitting member.

19 Claims, 3 Drawing Sheets

REFRIGERATOR HAVING WARMER COMPARTMENT

BACKGROUND OF THE INVENTION

The present invention relates to a refrigerator, and more particularly to a refrigerator having warmer compartment using heat from a compressor and a condenser mounted within a machine compartment.

In general, the refrigerator comprises a refrigerator compartment, a freezer compartment, and a machine compartment for cooling the refrigerator compartment and the freezer compartment. The machine compartment includes a compressor for compressing refrigerant to achieve a high temperature and pressure, a condenser for condensing the compressed refrigerant by exchanging heat with outer air, and a refrigerating fan for rapidly cooling the compressor and the condenser via forced convection of air.

When power is supplied to the refrigerator, an evaporator within the refrigerator absorbs heat from the air to cool the refrigerator compartment and the freezer compartment. The compressor and the condenser emit the absorbed heat of about 50° C.–60° C. to an indoor area in which the refrigerator is locked. Consequently, the temperature in the indoor area rises. In addition, since the thermal energy being emitted to the indoor area is not otherwise used, these refrigerators do not use energy efficiently.

SUMMARY OF THE INVENTION

An object of the present invention is to provide a refrigerator having a warmer compartment which uses heat from the machine compartment.

Another object of the present invention is to provide a refrigerator in which energy is used efficiently.

In order to achieve this object, the present invention comprises a freezer compartment, a refrigerator compartment, a warmer compartment, a machine compartment having a compressor and a condenser for cooling the freezer compartment and the refrigerator compartment, and a heat transmitter for transmitting heat from the machine compartment to the warmer compartment.

The heat transmitter includes a heat transmitting member for transmitting heat from the machine compartment to the warmer compartment, and a heat conducting member attached to the heat transmitting member for conducting heat from the machine compartment to the heat transmitting member. The heat conducting member comprises a heat conducting material contacting the heat transmitting member or a plurality of fins attached to the heat transmitting member. On the heat transmitting member within the warmer compartment, a plurality of fins are attached to improve the heat transmitting efficiency.

DETAILED DESCRIPTION OF THE INVENTION

Figure 1:
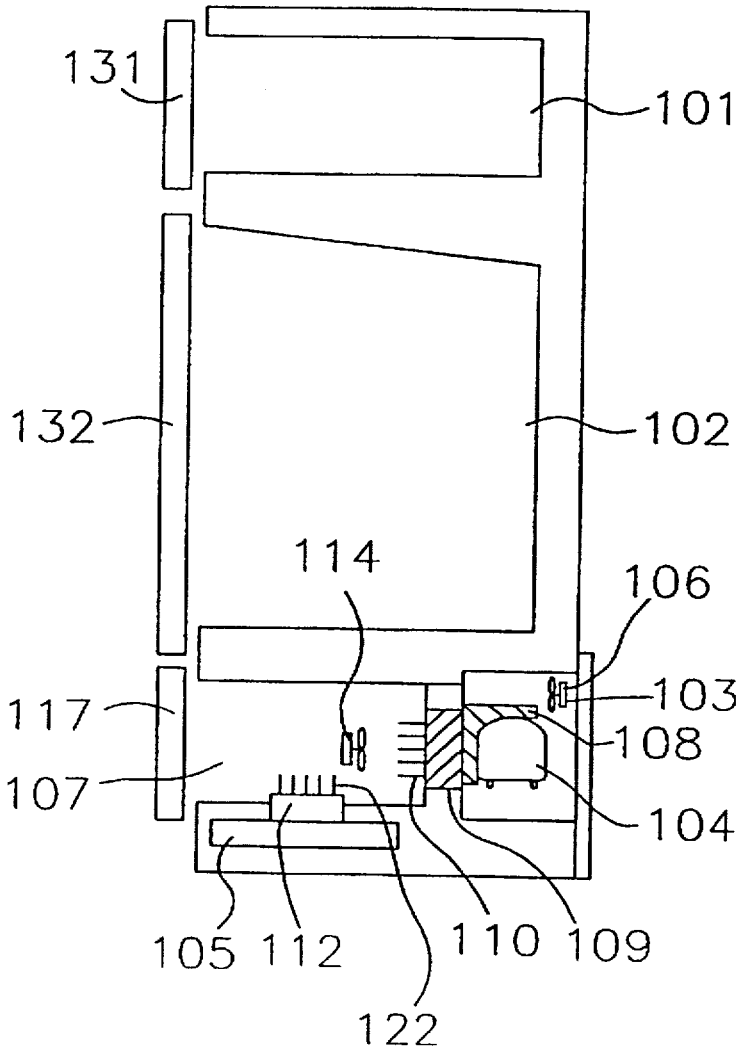
FIG. 1 is a sectional view of a refrigerator having a warmer compartment according to a first embodiment of the present invention.

FIG. 1 is a view showing a first embodiment of the present invention. As shown in FIG. 1, the refrigerator comprises freezer compartment 101 and refrigerator compartment 102. Freezer door 131 and refrigerator door 132 are attached to the front part of freezer compartment 101 and refrigerator compartment 102, respectively. FIG. 1 also includes machine compartment 103 for cooling freezer compartment 101 and refrigerator compartment 102, and warmer compartment 107 into which heat is supplied from machine compartment 103.

Machine compartment 103 includes compressor 104 for compressing the refrigerant to achieve a high temperature and pressure, and condenser 105 for condensing the compressed refrigerant to achieve an exchange of heat with the outer air. In a wall dividing machine compartment 103 and warmer compartment 107, first thermoelectric module 109 is mounted to transmit heat emanating from compressor 104 to warmer compartment 107. Heat conducting member 108 is mounted between first thermoelectric module 109 and compressor 104. Heat conducting member 108 contacts first thermoelectric module 109 and compressor 104, effectively transmitting heat from compressor 104 to warmer compartment 107. Second thermoelectric module 112, which is mounted in the wall, contacts condenser 105 to transfer heat from condenser 105 to warmer compartment 107. Each side of first thermoelectric module 109 and second thermoelectric module 112 have sides exposed to both the inner side of machine compartment 103 and warmer compartment 107.

On first thermoelectric module 109 and second thermoelectric module 112 within warmer compartment 107, a plurality of first fins 110 and second fins 122 are respectively attached for effectively transmitting heat. First fan 114 is mounted in machine compartment 103 to cool compressor 104 and condenser 105 and to effectively transfer heat from compressor 104 and condenser 105 to heat conducting member 108 through convection of air. Second fan 106 is mounted in warmer compartment 107 to warm the air in warmer compartment 107 using heat transmitted to fins 110 and 122 through first and second thermoelectric modules 109 and 112, respectively.

In the above mentioned refrigerator, the refrigerant is compressed in compressor 104 and is condensed in condenser 105. After the refrigerant is condensed, the refrigerant is evaporated by an evaporator (not shown in figure) which is mounted in freezer compartment 101 and refrigerator compartment 102 to cool the air in freezer compartment 101 and refrigerator compartment 102. At that time, heat emitted from compressor 104 is transmitted to first thermoelectric modules 109 through heat conducting member 108, and heat generated from condenser 105 is also transmitted to second thermoelectric module 112. First thermoelectric module typically include two kinds of metal that are attached to each other, or a p-type or an n-type semiconductor. When the voltage is applied to first and second thermoelectric modules 109 and 112, the metal or semiconductor is divided into a high temperature portion and a low temperature portion. This is called the Peltier effect. In this embodiment, the side of thermoelectric module 109 and 112 facing the inner space of machine compartment 103 is the low temperature portion, and the side facing warmer compartment 107 is the high temperature portion. Thus, when the voltage is applied to first and second thermoelectric modules 109 and 112, the low temperature portion absorbs heat from machine compartment 103 and emits heat to warmer compartment 107, effectively transferring heat to warmer compartment 107. In general, compressor 103 and condenser 104 emit heat ranging from 30° C.–50° C. A temperature difference of about 10° C.–30° C. in a refrigerating cycle is indicative of good efficiency. Therefore, the temperature of warmer compartment 107 increases by approximately 10° C.–20° C. as a result of heat emitted from compressor 104 and condenser 105.

At this time, since first thermoelectric module 109 contacts compressor 104 through conducting member 108 which conducting material, heat is effectively transmitting from compressor 104 to warmer compartment 107. Further, because first and second fins 110 and 122 within machine compartment 103 and warmer compartment 107, warmer compartment 107 is warmed rapidly.

Figure 2:
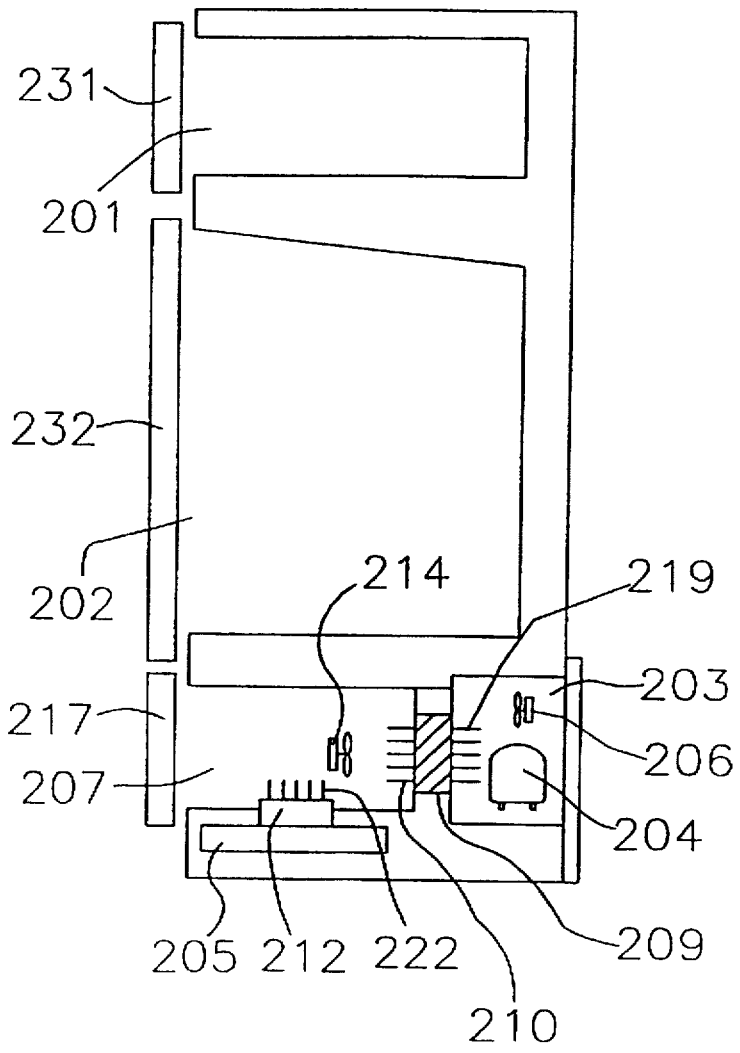
FIG. 2 is a sectional view of a refrigerator having a warmer compartment according to a second embodiment of the present invention.

FIG. 2 is a view illustrating the second embodiment of the present invention. In this embodiment, compressor 204 and condenser 205 are mounted in machine compartment 203. A plurality of first fins 210 are attached to first heating transmitting module 209 within warmer compartment 207, enlarging the surface area contacting the air within warmer compartment 207. In first thermoelectric module 209 within machine compartment 203, a plurality of third fins 219 are attached to conduct heat emitted from compressor 204 to first thermoelectric module 209. That is, third fins 219 are used as a conducting member in this embodiment. The heat emitted from condenser 205 is supplied to warmer compartment 207 through second thermoelectric module 212. To improve the heat transmitting efficiency, second fins 222 are attached on the second thermoelectric module 212 within warmer compartment 207. First fan 214 and second fan 215 are respectively mounted within machine compartment 203 and warmer compartment 207 to forcibly convect the air.

Figure 3:
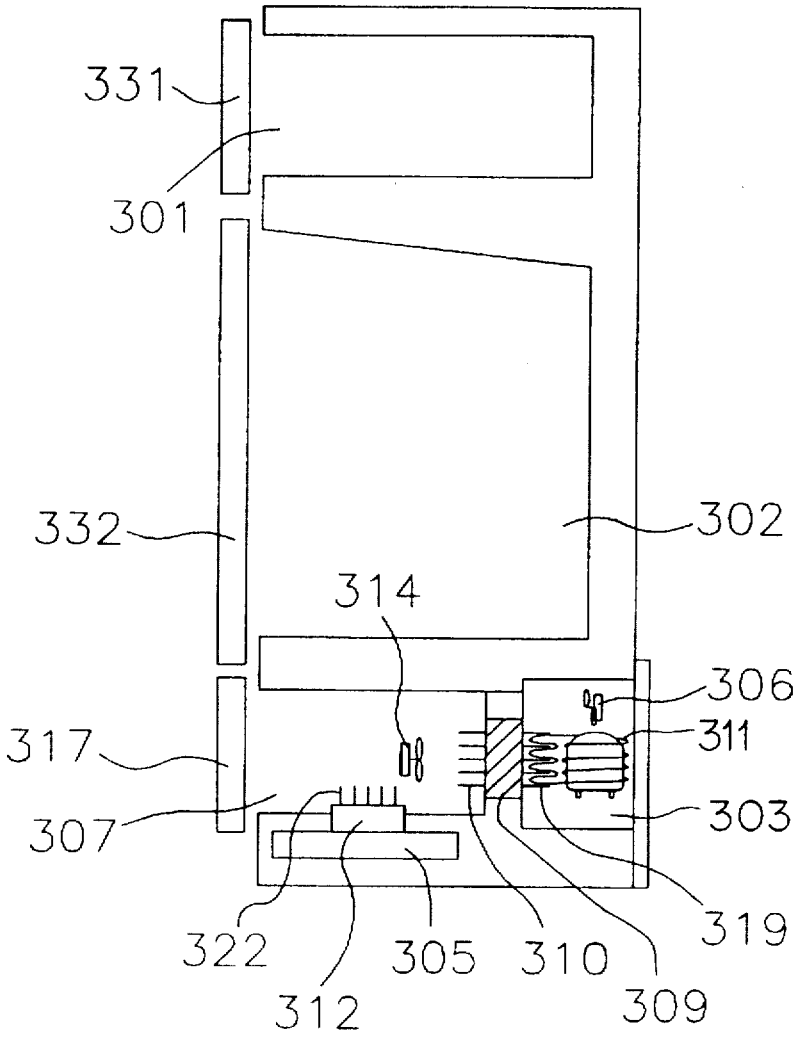
FIG. 3 is a sectional view of a refrigerator having a warmer compartment according to a third embodiment of the present invention.

FIG. 3 is a view showing the third embodiment of the present invention. In this embodiment, heat pipe 311 surrounds the circumference of compressor 304 and is passed between each fin of third fin 319. More specifically, heat pipe 311 passes between the heat conducting members attached on first thermoelectric module 309 within machine compartment 303. Thus, the heat transmitting medium flowing through heat pipe 311 absorbs heat while flowing near the circumference of compressor 304 and then emits heat to third fins 319 while flowing between each fin of third fin 319. Heat emitted from compressor 304 is therefore transmitted to warmer compartment 307 through third fins 319 and first thermoelectric module 309.

Since machine compartment 303, which contains the heat emitted from compressor 304 and condenser 305, supplies heat to warmer compartment 307 as a thermal source, the energy efficiency of the refrigerator is improved. By transmitting the heat to the warmer compartment 307, compressor 304 and condenser 305 are cooled more rapidly to improve the efficiency of the refrigerating cycle. In addition, because heat from compressor 304 and condenser 305 is not emitted to the area surrounding the refrigerator, but is instead transmitting to warmer compartment 307, increases in indoor temperature do not occur as a result of the refrigeration process of the present invention.

While the preferred form of the present invention has been described, it is to be understood that modifications will be apparent to those skilled in the art without departing from the spirit of the invention.

The scope of the invention, therefore, is to be determined solely by the following claims.

What is claimed is:

1. A refrigerator, comprising:

a warmer compartment;

a machine compartment including a compressor and a condenser, the compressor and condenser emitting heat to the machine compartment; heat transmitting means for transmitting heat from the machine compartment to the warmer compartment, wherein the heat transmitting means includes at least one heat transmitting member for transmitting heat emitted from the machine compartment to the warmer compartment;

at least one heat conducting member for conducting heat from the machine compartment to the heat transmitting member; and plural fins attached to the heat transmitting member and positioned within the warmer compartment.

2. A refrigerator having a warmer compartment according to claim 1, wherein the heat transmitting member includes a thermoelectric module, the thermoelectric module being mounted between the warmer compartment and the machine compartment.

3. A refrigerator having a warmer compartment according to claim 2, wherein the thermoelectric module includes two kinds of metal, the two kinds of metal being attached to each other.

4. A refrigerator having a warmer compartment according to claim 2, wherein the thermoelectric module includes a semiconductor.

5. A refrigerator having a warmer compartment according to claim 1, wherein the heat conducting member includes a conducting material contacting at least one of the compressor and the condenser.

6. A refrigerator having a warmer compartment according to claim 1, wherein the conducting member includes a plurality of first fins attached to the heat transmitting member within the machine compartment.

7. A refrigerator having a warmer compartment according to claim 6, further comprising a heat pipe surrounding a circumference of the compressor, the heat pipe passing between the first fins, a heat transmitting medium flowing through the heat pipe to transmit heat from the compressor to the first fins.

8. A refrigerator having a warmer compartment according to claim 1, further comprising a first fan within the machine compartment for circulating a medium used to transmit heat from the machine compartment to the heat transmitting member.

9. A refrigerator having a warmer compartment according to claim 1, further comprising a fan within the warmer compartment for circulating a medium used to transmit heat from the heat transmitting member to air within the warmer compartment.

10. A refrigerant comprising:

a freezer compartment;

a refrigerator compartment;

a warmer compartment;

a machine compartment including a compressor and a condenser, the compressor and the condenser emitting heat to the machine compartment;

at least one heat transmitting member between the warmer compartment and the machine compartment, the heat transmitting member transmitting heat emitted by the compressor and the condenser from the machine compartment to the warmer compartment; and plural fins attached to the heat transmitting member and positioned within the warmer compartment.

11. A refrigerator according to claim 10, wherein the heat transmitting member includes a thermoelectric module, the thermoelectric module being mounted between the warmer compartment and the machine compartment.

12. A refrigerator according to claim 11, wherein the thermoelectric module includes two kinds of metal, the two kinds of metal being attached to each other.

13. A refrigerator according to claim 11, wherein the thermoelectric module includes a semiconductor.

14. A refrigerator according to claim 10, further comprising at least one heat conducting member within the machine compartment for conducting heat from the machine compartment to the warmer compartment.

15. A refrigerant according to claim 14, wherein the conducting member includes a heat conducting material contacting at least one of the compressor and the condenser.

16. A refrigerator according to claim 14, wherein the conducting member includes a plurality of first fins attached to the heat transmitting member within the machine compartment.

17. A refrigerator according to claim 16, further comprising a heat pipe surrounding a circumference of the compressor, the heat pipe passing between the first fins, a heat transmitting medium flowing through the heat pipe to transmit heat from the compressor to the first fins.

18. A refrigerator according to claim 10, further comprising a first fan within the machine compartment for circulating a medium used to transmit heat from the machine compartment to the heat transmitting member.

19. A refrigerator according to claim 10, further comprising a fan within the warmer compartment for circulating a medium used to transmit heat from the heat transmitting member to air within the warmer compartment.

* * * * *